US005366175A

United States Patent [19]

Schutz

[11] Patent Number: 5,366,175

[45] Date of Patent: Nov. 22, 1994

[54] APPARATUS FOR DISPENSING WEB MATERIAL FROM A CORELESS ROLL HAVING ANTI-THEFT DEVICE

[75] Inventor: Rudolph W. Schutz, Walnut Creek, Calif.

[73] Assignee: James River Paper Company, Inc., Richmond, Va.

[21] Appl. No.: 132,878

[22] Filed: Oct. 7, 1993

[51] Int. Cl.[5] ..... B65H 75/02

[52] U.S. Cl. ..... 242/597.6; 242/596.7

[58] Field of Search ..... 242/55.2, 55.54, 55.3, 242/55.42, 68, 68.3, 68.5; D6/518, 521, 522, 523

[56] References Cited

U.S. PATENT DOCUMENTS

| | | | |
|---|---|---|---|
| 864,057 | 7/1907 | Anderson | 242/68.5 |
| 1,093,334 | 4/1914 | Johnson | 242/55.2 |
| 1,817,897 | 8/1931 | Johnson | 242/55.2 |
| 2,380,644 | 7/1945 | Grondona | 242/55.2 |
| 2,477,362 | 7/1949 | Cavalieri | 242/55.2 |
| 2,562,923 | 8/1951 | Kolivoski | 242/55.2 |
| 2,632,605 | 3/1953 | Lee | 242/55.2 |
| 3,656,699 | 4/1972 | Schnyder et al. | 242/55.3 |
| 3,917,185 | 11/1975 | Canada et al. | 242/68.5 |
| 4,248,391 | 2/1981 | Ness | 242/55.54 |
| 4,905,923 | 3/1990 | Dudley | 242/55.53 |
| 4,984,915 | 2/1991 | Tashiro et al. | 242/55.2 X |
| 5,100,075 | 3/1992 | Morand | 242/55.2 |

*Primary Examiner*—Daniel P. Stodola
*Assistant Examiner*—John Q. Nguyen
*Attorney, Agent, or Firm*—Thomas R. Lampe

[57] ABSTRACT

Apparatus for dispensing web material from a coreless roll of such material includes a rotatable shaft having a helical-shaped projection on the outer surface thereof. The projection resists end-wise removal of the roll from the shaft as long as the shaft is free to rotate. A lock arrangement is provided to prevent rotation of the shaft after the roll has been substantially depleted so that end-wise removal of the roll can be manually accomplished.

10 Claims, 2 Drawing Sheets

APPARATUS FOR DISPENSING WEB MATERIAL FROM A CORELESS ROLL HAVING ANTI-THEFT DEVICE

TECHNICAL FIELD

This invention relates to apparatus for dispensing web material from a coreless roll of such material. The invention has particular application to dispensing paper from a coreless paper roll having a plurality of convolutions and a central opening defined by the innermost convolution. The apparatus incorporates structure which deters against theft of a coreless roll until it has been substantially depleted.

BACKGROUND ART

It is known in the prior art to form and make available coreless rolls of toilet tissue, paper toweling and the like. Such products incorporate no inner core and are comprised wholly of a plurality of convolutions of the paper itself. A central opening is defined by the innermost roll convolution and the central opening can accommodate spindles and shafts to support the roll as it is dispensed by being unwound by a consumer.

Of course, if some means is not provided to prevent end-wise movement of the roll relative to the support spindle or shaft, the roll may be removed in its entirety simply by manually pulling it end-wise from the spindle or shaft.

One approach for preventing end-wise removal of a coreless roll from its support shaft is to position the roll and support shaft within the confines of a cabinet. Cabinets, however, add to the cost of the dispenser, may be inconvenient to service, and are not always appropriate for use. Mechanisms have been devised in the nature of barbed shafts or spindles which will resist end-wise removal of the roll product. While mechanisms of the type just described are effective for preventing end-wise removal of a coreless roll from the support shaft incorporating the barbs, the innermost convolutions of the coreless roll may be cut or substantially damaged by the mechanism. Furthermore, barbs will continue to resist end-wise movement of a coreless roll relative to the shaft incorporating the barbs until the very last convolutions of the roll product have been dispensed due to unwinding of the roll. This may not always be desirable, particularly in institutional settings where maintenance personnel may wish to remove a stub (substantially depleted) roll and replace it with a full roll.

A search directed to the present invention located the following United States patents: U.S. Pat. No. 5,100,075, issued Mar. 31, 1992, U.S. Pat. No. 4,984,915, issued Jan. 15, 1991, U.S. Pat. No. 4,905,923, issued Mar. 6, 1990, U.S. Pat. No. 3,656,699, issued Apr. 18, 1972, U.S. Pat. No. 2,632,605, issued Mar. 24, 1953, U.S. Pat. No. 2,562,923, issued Aug. 7, 1951, U.S. Pat. No. 3,477,362, issued Jul. 26, 1949, U.S. Pat. No. 2,380,644, issued Jul. 31, 1945, U.S. Pat. No. 1,817,897, issued Aug. 4, 1931, and U.S. Pat. No. 1,093,334, issued Apr. 14, 1914.

The above-identified patents do not address the problems discussed above and solved by the present invention.

DISCLOSURE OF INVENTION

The apparatus of the present invention is for dispensing web material, such as paper, from a coreless roll comprised of a plurality of convolutions of web material and having a central opening defined by the innermost convolution of the web material. The invention provides for ease of installation of the coreless roll on the apparatus so that the coreless roll can be dispensed by unwinding in the conventional manner but resists end-wise movement of the coreless roll on a support shaft until the roll has been substantially depleted during normal use by one or more consumers, i.e. by virtue of unwinding of the coreless roll.

The invention is characterized by its simplicity, reliability, and relatively low cost. No external cabinet structure is required to deter against theft of other than a stub roll. Furthermore, an attendant can, if desired, remove the roll from the support shaft at any time after substantial depletion of the roll.

The apparatus is for dispensing web material from a coreless roll comprised of a plurality of convolutions of web material and having a central opening defined by the innermost convolution of the web material.

The apparatus includes support means. A shaft is rotatably mounted relative to the support means and has an outer peripheral surface. The shaft is for insertion into the central opening of a coreless roll whereby the coreless roll can be rotated relative to the support means to dispense web material from the coreless roll.

Manually operable lock means is provided for preventing rotation of the shaft relative to the support means.

Roll retention means is operatively associated with the shaft and a coreless roll supported by the shaft to allow end-wise movement of the coreless roll relative to the shaft and end-wise removal of the coreless roll from the shaft when the lock means is activated and prevents rotation of the shaft relative to the support means. The roll retention means substantially resists end-wise movement of the coreless roll relative to the shaft and end-wise removal of the coreless roll from the shaft when the lock means is deactivated and allows rotation of the shaft relative to the support means.

The roll retention means comprises a generally helical-shaped projection on the outer peripheral surface of the shaft. The generally helical-shaped projection progresses along at least a portion of the length of the shaft for engagement with a coreless roll mounted on the shaft.

The lock means includes a movable lock element connected to the shaft and rotatable with the shaft. A lock element is movable between a first location wherein the lock element engages the support means and prevents rotational movement of the shaft relative to the support means and a second location wherein the lock element is disengaged from the support means and allows rotational movement of the shaft relative to the support means.

Other features, advantages, and objects of the present invention will become apparent with reference to the following description and accompanying drawings.

BEST MODE FOR CARRYING OUT THE INVENTION

Figure 1:
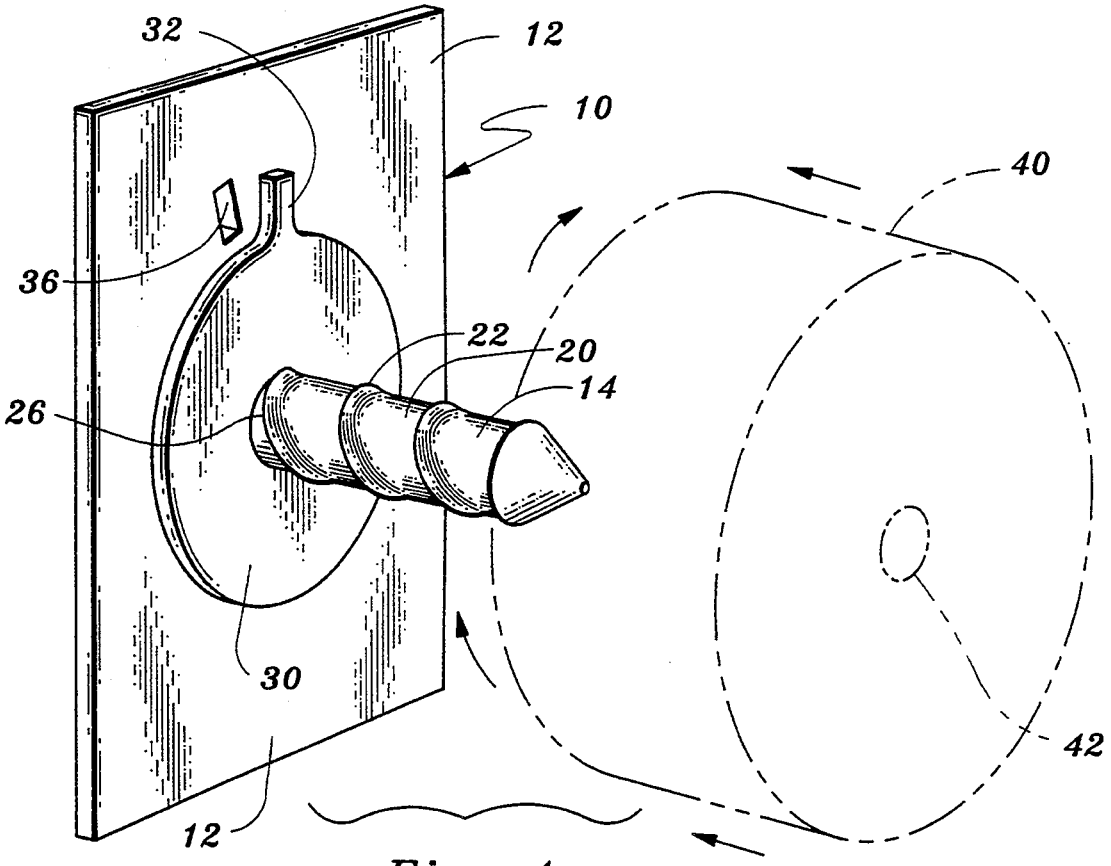
FIG. 1 is a perspective view of apparatus constructed in accordance with the teachings of the present invention prior to application of a full coreless paper roll thereto.
Figure 2:
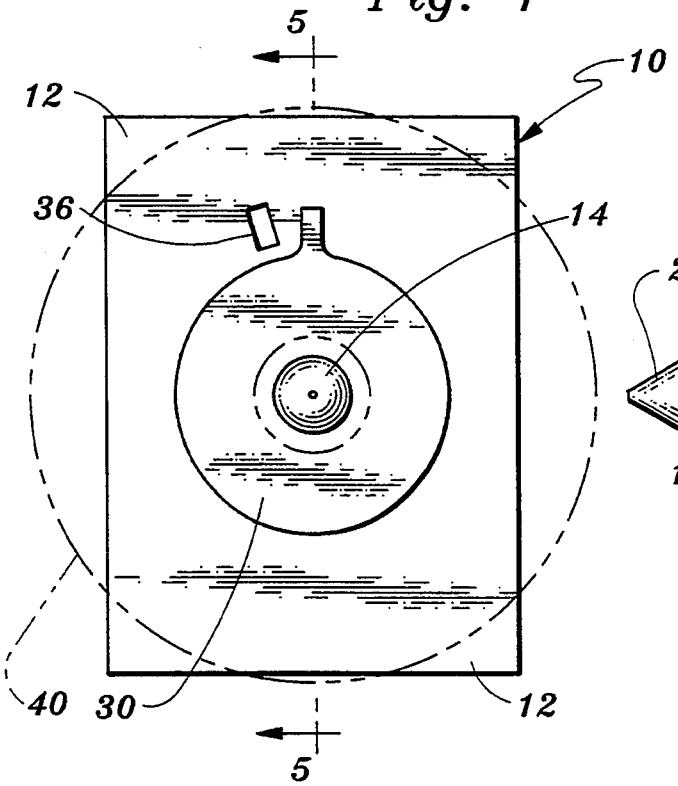
FIG. 2 is a front view of the apparatus.
Figure 3:
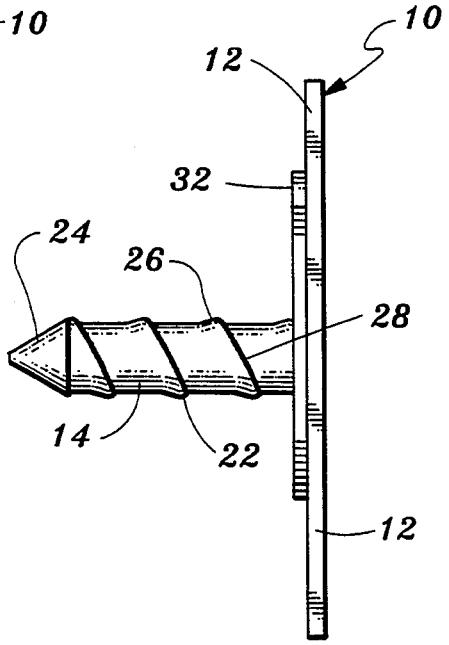
FIG. 3 is a side view of the apparatus.

Referring now to the drawings, apparatus constructed in accordance with the teachings of the present invention is designated by reference numeral 10. Apparatus 10 includes a support member 12 in the form of a flat plate.

Support member 12 may be affixed at any desired location such as a wall by conventional fastener means (not shown).

Figure 4:
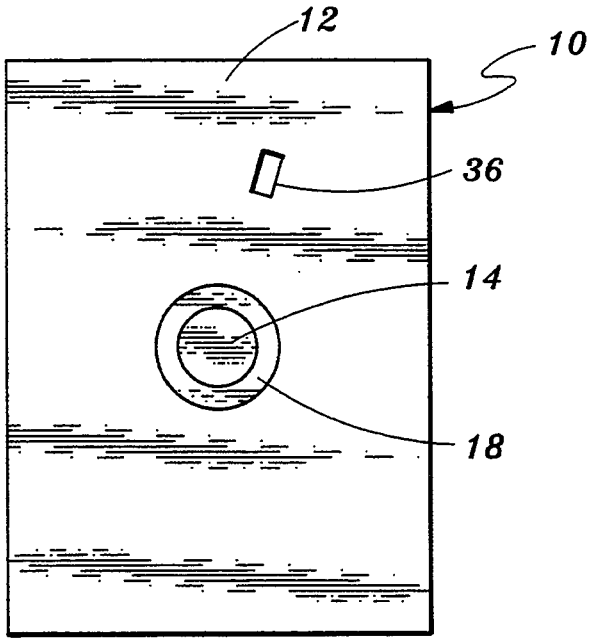
FIG. 4 is a rear view of the apparatus.
Figure 5:
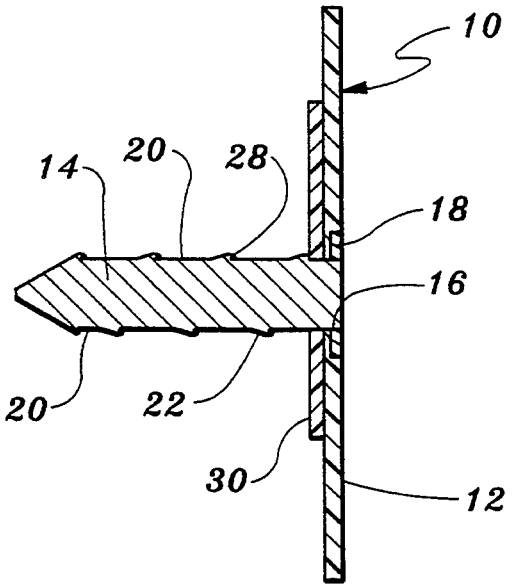
FIG. 5 is a cross-sectional view of the apparatus taken along line 5—5 in FIG. 2.

A shaft 14 is rotatably mounted on support member 12. Any suitable means may be utilized to accomplish rotatable mounting of the shaft. FIG. 4 illustrates one such arrangement wherein the shaft projects through an aperture 16 in support member 12. A circular flange 18 affixed to the shaft 14 is disposed in a corresponding recess formed at the back of the support member and is rotatable therein along with the shaft. Of course, more complicated arrangements involving bearings or the like may be utilized if desired.

Shaft 14 has a circular-shaped outer peripheral surface 20. A helical-shaped projection is on the outer peripheral surface and progresses along the majority of the length of the shaft. Projection 22 extends inwardly toward the support member 12 from a tapered head 24 at the distal end of the shaft.

The helical-shaped projection 22 has a sloped, ramp-like, front surface 26 and a rear surface 28 projecting outwardly from the shaft peripheral surface.

Figure 6:
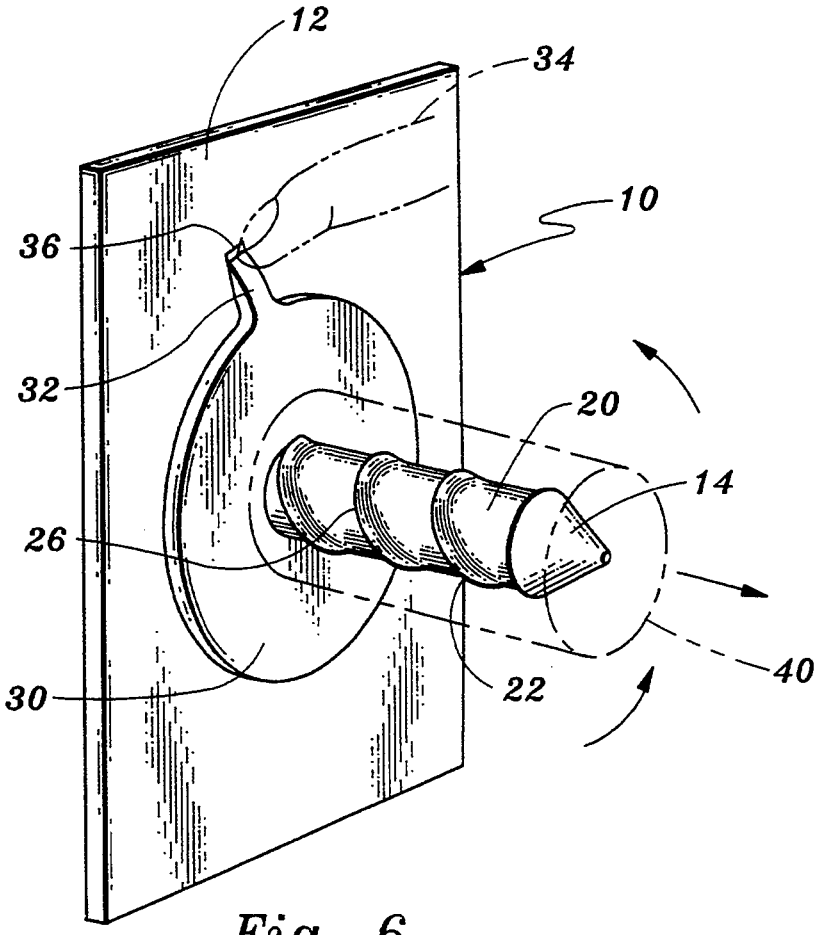
FIG. 6 shows the substantially depleted coreless roll on the apparatus and a lock element being manually actuated to prevent rotation of the apparatus coreless roll support shaft.

Affixed to shaft 14 and rotatable therewith is a roll abutment plate. Roll abutment plate 30 is closely adjacent to support member 12. A tab-like lock element or detent 32 projects outwardly from the plate 30 and normally assumes a position (shown in FIG. 1) where the lock element is essentially in alignment with the plate 30. However, the lock element or tab 32 can be deflected toward support member 12 upon application of suitable force thereto. Deflected lock element 32 is shown in FIG. 6, the deflecting force being applied by a human finger 34. The lock element or detent 32 in FIG. 6 is shown as entering an indent or hole 36 formed in support member 12 and in registry with the lock element 32 once every revolution of the shaft 14 and plate 30. As shown, the lock element 32 and plate 30 are of integral construction. As is the case with respect to the other components of the apparatus 10, any suitable material may utilized in the construction of the plate and lock element, e.g. plastic.

Shaft or spindle 14 is for the purpose of holding a toilet tissue roll 40 to allow dispensing thereof in a conventional manner upon rotation of the shaft and roll. The roll 40 is readily applied to the shaft by placing the shaft head 24 in the central opening 42 of the coreless roll which is defined by the innermost convolution of the roll. Installation of the roll on the shaft is readily accomplished by pushing the roll toward the support member 12, with the ramp-like front surface of projection 22 facilitating sliding of the roll over the projection until the roll abuts or comes close to abutting plate 30.

Outward pulling of the roll away from the support member 12 will be resisted in a substantial manner, however, due to the fact that rear surface 28 of the projection engages the coreless roll in a more positive fashion. Preferably the rear surface of the helical-shaped projection 22 defines an angle with the outer peripheral surface of the shaft not exceeding about 90 degrees.

Installation of the roll 40, at least at the initial stages of the operation, can be facilitated by locking shaft 14 against rotation and rotating the roll so that it "screws on" the shaft by following the contours of projection 22. For example, rotational movement of the shaft may be prevented by pressing the lock element 32 into indent 36 as shown in FIG. 6 until the roll nears plate 30.

Any attempt, however, to "unscrew" the roll 40 from shaft 18 will be stymied due to the fact that the shaft will rotate when outside rotational forces are applied to the roll. Thus, the roll 40 cannot readily be removed endwise from the shaft 14 and the roll must be dispensed by unwinding. However, when the size of the roll has depleted sufficiently to form a stub roll of considerably less convolutions than the number of convolutions forming a full roll, the lock element 32 will be exposed and can be pressed manually into indent 36 to prevent rotation of plate 30 and shaft 14. Now the roll can be "unwound" from the shaft about projection 22 by rotating the roll counter clockwise as illustrated in FIG. 6.

I claim:

1. Apparatus for dispensing web material from a coreless roll comprised of a plurality of convolutions of web material and having a central opening defined by the innermost convolution of said web material, said apparatus comprising, in combination:

support means for supporting a coreless roll;

a shaft rotatably mounted on said support means and having an outer peripheral surface, said shaft for insertion into the central opening of a coreless roll whereby the coreless roll can be rotated relative to said support means to dispense web material from said coreless roll;

lock means for selectively preventing rotation of said shaft relative to said support means; and roll retention means operatively associated with said shaft and a coreless roll on said shaft to allow axial movement of the coreless roll relative to said shaft and axial removal of said coreless roll from said shaft when said lock means is activated to prevent rotation of said shaft relative to said support means and to substantially resist axial movement of said coreless roll relative to said shaft and axial removal of said coreless roll from said shaft when said lock means is deactivated to allow rotation of said shaft relative to said support means, said lock means including a manually actuable movable lock element connected to said shaft and rotatable with said shaft, said lock element movable between a first location wherein said lock element engages said support means and prevents rotational movement of said shaft relative to said support means and a second location wherein said lock element is disengaged from said support means and allows rotational movement of said shaft relative to said support means.

2. The apparatus according to Claim 1 wherein said roll retention means comprises a generally helical-shaped projection on the outer peripheral surface of said shaft, said generally helical-shaped projection progressing along at least a portion of the length of said shaft for engagement with a coreless roll mounted on said shaft.

3. The apparatus according to Claim 2 wherein said generally helical-shaped projection has a sloped, ramp-like first surface for engagement by a coreless roll being mounted axially onto said shaft in a direction towards said support means and a second surface projecting outwardly from said shaft outer peripheral surface for engaging a coreless roll mounted on said shaft and resisting movement of the coreless roll outwardly away from said support means.

4. The apparatus according to Claim 3 wherein said second surface of said generally helical-shaped projection defines an angle with the outer peripheral surface of said shaft not exceeding about ninety degrees.

5. The apparatus according to Claim 2 wherein said manually operable lock means is located a distance from said shaft so that the manually operable lock means will be covered by a coreless roll mounted on said shaft and cannot be manually accessed and operated until the coreless roll mounted on the shaft is substantially depleted, axial removal of a substantially depleted coreless roll from said shaft being manually effected by rotating said substantially depleted coreless roll relative to said shaft about said generally helical-shaped projection when said lock means is manually activated and said shaft is locked against rotational movement by said lock means.

6. The apparatus according to Claim 1 wherein said lock element comprises a manually actuatable detent member, said support means defining an indent for selectively receiving said detent.

7. The apparatus according to Claim 6 wherein said manually actuatable detent member is covered by a coreless roll of web material mounted on said shaft until substantial depletion of said coreless roll.

8. The apparatus according to Claim 7 wherein said apparatus additionally comprises a plate connected to said shaft adjacent to said support means and rotatable with said shaft relative to said support means, said manually actuatable detent member being connected to said plate and rotatable therewith.

9. The apparatus according to Claim 7 wherein said indent is located a predetermined distance from said support shaft.

10. Apparatus for dispensing web material from a coreless roll comprised of a plurality of convolutions of web material and having a central opening defined by the innermost convolution of said web material, said apparatus comprising, in combination:

support means for supporting a coreless roll;

a shaft rotatably mounted on said support means and having an outer peripheral surface, said shaft for insertion into the central opening of a coreless roll whereby the coreless roll can be rotated with said shaft relative to said support means to dispense web material from said coreless roll;

lock means for selectively preventing rotation of said shaft relative to said support means, said lock means including a manually actuable movable lock element connected to said shaft and rotatable with said shaft, said lock element movable between a first location wherein said lock element engages said support means and prevents rotational movement of said shaft relative to said support means and a second location wherein said lock element is disengaged from said support means and allows rotational movement of said shaft relative to said support means; and a generally helical-shaped projection on the outer peripheral surface of said shaft and extending along at least a portion of the length of said shaft, a coreless roll mounted on said shaft in frictional engagement with said projection, said roll being rotatable relative to said shaft and said generally helical-shaped projection when said shaft is prevented from rotating relative to said support means by said lock means and a coreless roll mounted on said shaft being non-rotatable relative to said shaft and said generally helical-shaped projection when rotation of said shaft relative to said support means is not prevented by said lock means.

* * * * *